United States Patent [19]

Cunha et al.

[11] Patent Number: 4,798,141

[45] Date of Patent: Jan. 17, 1989

[54] MISSILE EQUIPMENT SECTION STRUCTURE

[75] Inventors: Daniel Cunha, Felton; Wayne M. Brown, San Jose; James E. Pool, Saratoga; Thomas M. Sheperd, Cupertino, all of Calif.

[73] Assignee: The United States of America as represented by the Secretary of the Navy, Washington, D.C.

[21] Appl. No.: 82,777

[22] Filed: Jul. 31, 1987

[51] Int. Cl.[4] ..... F42B 15/00

[52] U.S. Cl. ..... 102/293

[58] Field of Search ..... 102/293, 374, 377, 378; 244/54, 117 R, 119, 129.1

[56] References Cited

U.S. PATENT DOCUMENTS

| | | | |
|---|---|---|---|
| 2,627,231 | 2/1953 | Kraemer | 102/374 |
| 2,976,806 | 3/1961 | Risk et al. | 102/374 |
| 2,992,794 | 7/1961 | Boyd | 102/378 |
| 3,345,946 | 10/1967 | Johnson et al. | 102/377 |
| 3,699,891 | 10/1972 | Kreuzer et al. | 102/374 |
| 3,995,081 | 11/1976 | Fant et al. | 428/119 |
| 4,007,898 | 2/1977 | Brenner et al. | 248/26 |
| 4,665,792 | 5/1987 | Gassler et al. | 102/293 |

*Primary Examiner*—Charles T. Jordan

*Attorney, Agent, or Firm*—C. D. B. Curry; W. C. Daubenspeck; K. S. Moss

[57] ABSTRACT

A plurality of pan-shaped beams and supports of graphite/epoxy laminate material are mounted on a circular graphite/epoxy aft panel to form a symmetrical structure which is attached to the missile shell. Four main stiffening beams intersect at right angles to form a central square structure with the intersecting walls extending outward beyond the central square to the missile shell. Four diagonal stiffening beams are disposed across the corners within the central square to form a central hexagonal structure. Additional stiffness is provided by strut support beams oriented parallel to the main support beams and support ribs oriented perpendicular to the main support beams.

9 Claims, 6 Drawing Sheets

MISSILE EQUIPMENT SECTION STRUCTURE

BACKGROUND OF THE INVENTION

This invention relates in general to missile structures and, in particular, to a missile structure for providing structural support for a third stage motor, missile payload, electrical packages, and post-boost control systems.

Missile body structures in general are required to provide high stiffness and, at the same time, to be formed from a light weight material. In a multistage missile, for example, an upper stage missile body structure may provide support for a rocket motor mounted within the vehicle body and also provide housing and support for various required accessory systems including electrical packages, post-boost control systems, and the missile payload. The structure should allow flexibility in the design and location of accessory systems. The structure should provide easy installation of the various equipments and also provide accessibility for servicing. It is advantageous that the structure is easily manufactured and minimizes the number and type of parts required to reduce both the cost of production and the required inventories.

SUMMARY OF THE INVENTION

It is therefore an object of the present invention to provide a missile structure for providing structural support in an upper stage of a multistage missile.

Another object is to provide a light-weight missile support structure providing the required high stiffness.

Another object is to provide a missile support structure that is easily manufactured and minimizes the number and type of parts.

Another object is to provide a missile support structure allowing flexibility in the design and location of accessory systems to promote ease of installation and access for servicing.

Briefly, the missile structure of the present invention comprises a plurality fo pan-shaped beams and supports of graphite/epoxy laminate material mounted on a circular graphite/epoxy aft panel. The beams and supports form a symmetrical structure which is attached to the missile shell. Four main stiffening beams intersect at right angles to form a central square structure with the intersecting walls extending outward beyond the central square to the missile shell. Four diagonal stiffening beams are disposed across the corners within the central square to form a central hexagonal structure. Additional stiffness is provided by strut support beams oriented parallel to the main suport beams and support ribs oriented perpendicular to the main support beams.

Other object and many of the attendant advantages will be readily appreciated as the present invention becomes better understood by reference to the following detailed description when considered in conjunction with the accompanying drawings wherein:

DESCRIPTION OF THE PREFERRED EMBODIMENT

Figure 3:
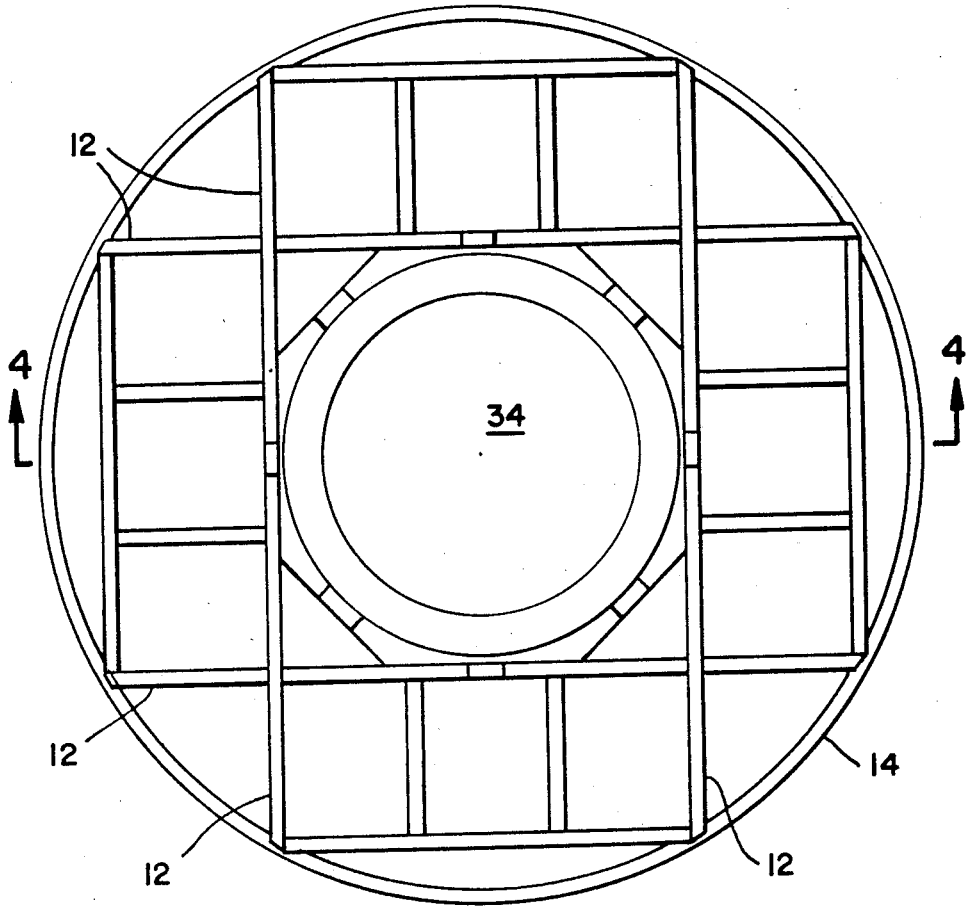
FIG. 3 is a plan view illustrating the embodiment of FIG. 1.
Figure 4:
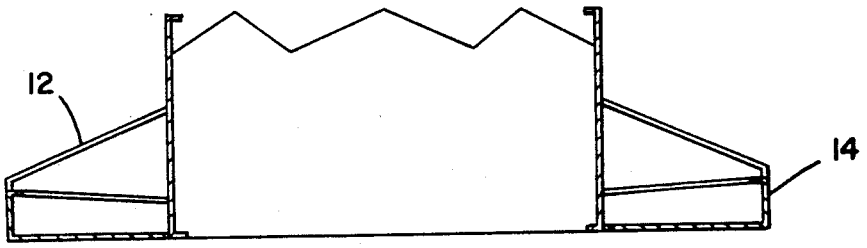
FIG. 4 is a cross-sectional view along line 4—4 in FIG. 3.

Referring now to the drawings, wherein like reference characters designate like or corresponding parts throughout the several views, the missile support structure is indicated in general by numeral 10 and is composed of a plurality of pan-shaped beams and supports joined together to form the symmetrical structure. In the preferred embodiment, the supporting members are made of graphite/epoxy laminated material and the plates and flanges which are used to join the supporting members together are of aluminum. Four main stiffening beams 12 are disposed to intersect at right angles to form a square structure with the intersecting walls extending outward beyond the central square to the missile shell 14 (shown in FIG. 3). Each main beam 12 is maximum height at its midpoint 16 and tapers to its minimum height at its ends 18*a* and 18*b*.

Each main beam 12 is comprised of a main section 20 and an end section 22. The main section 20 extends from one end 18*a* of the main beam through the midpoint 16 to the point of intersection with the main section 20 of the orthogonal main beam. The end section 22 extends from the intersection of the orthogonal main sections 20 to the other end 18*b* of the main beam. The main section 20 and the end section 22 of each main beam 12 are joined together by splice plates 24 attached by suitable fasteners. In general throughout the structure, swage type fasteners such as huck fasteners are preferred where shear loading is expected and threaded fasteners such as hi-lock fasteners are preferred where tension loads are expected.

Figure 2:
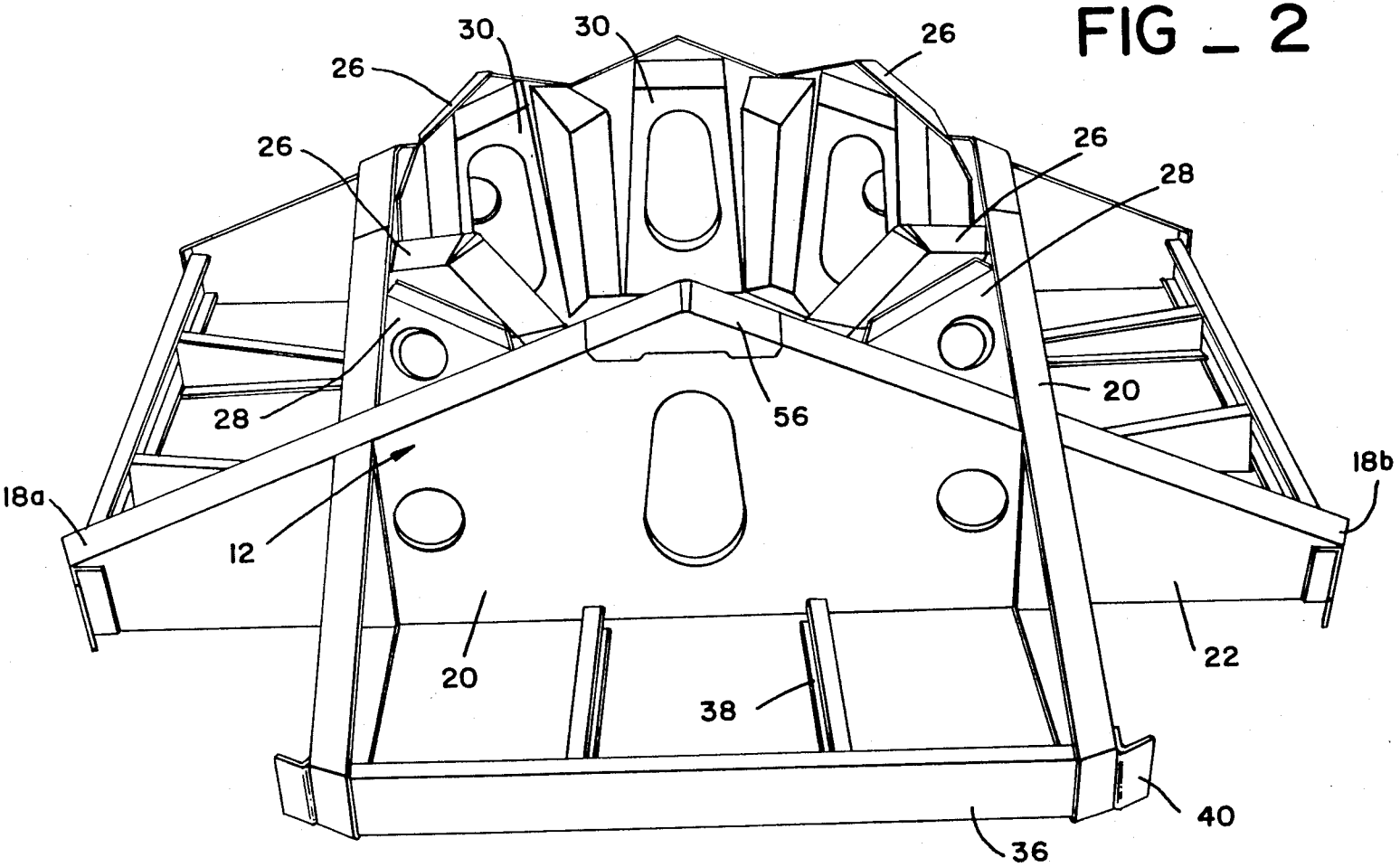
FIG. 2 is a perspective view illustrating the primary elements of the structure.

Four diagonal stiffening beams 26 are disposed across the corners of the central square structure to form an octagonal central structure in conjunction with the four main stiffening beams 12. Triangular support plates 28 (shown in FIG. 2) are mounted in the corners between the diagonal stiffening beams 16 and intersecting main stiffening beams. Bracing pans 30 are attached at the center of each main beam and at the center of each diagonal beam to provide more strength to the central octagonal structure.

The octagonal structure formed by main beams 12 and the diagonal beams 26 is mouned on a circular aft panel 32. The aft panel 32 has a central opening 34 allowing the rocket motor to be mounted within and pass through the support structure.

The structure is further stiffened by four pan-shaped strut supports beams 36 and eight pan-shaped support ribs 38. The strut support beams are fastened to the aft panel 32 and extend, parallel to each main beam 12, between ends 18*a* and 18*b* of the two orthogonal main beams 12. Turn-out flanges 40 are provided for joining the strut support beams 36 to the ends 18*a* and 18*b* of the main beams 12 and also for attaching the ends 18*a* and 18*b* to the missile shell 14. The support ribs 38 are mounted on the aft panel 32 and extend between the main beams 12 and the strut support beams 36. The support ribs 38 are joined to the main beams by turn-out flanges 42 and to the strut support beams 36 by splice plates 44.

Strut supports 46 are mounted between the aft panel 32 and the strut support beams 36 at the location where the support ribs 38 are connected to the strut support beam. The strut supports 46 have a turn-up flange 48 for attachment to the missile shell 14. Turn-out flanges 50 are provided for attaching the strut supports 46 to the strut support beams 38.

Figure 1:
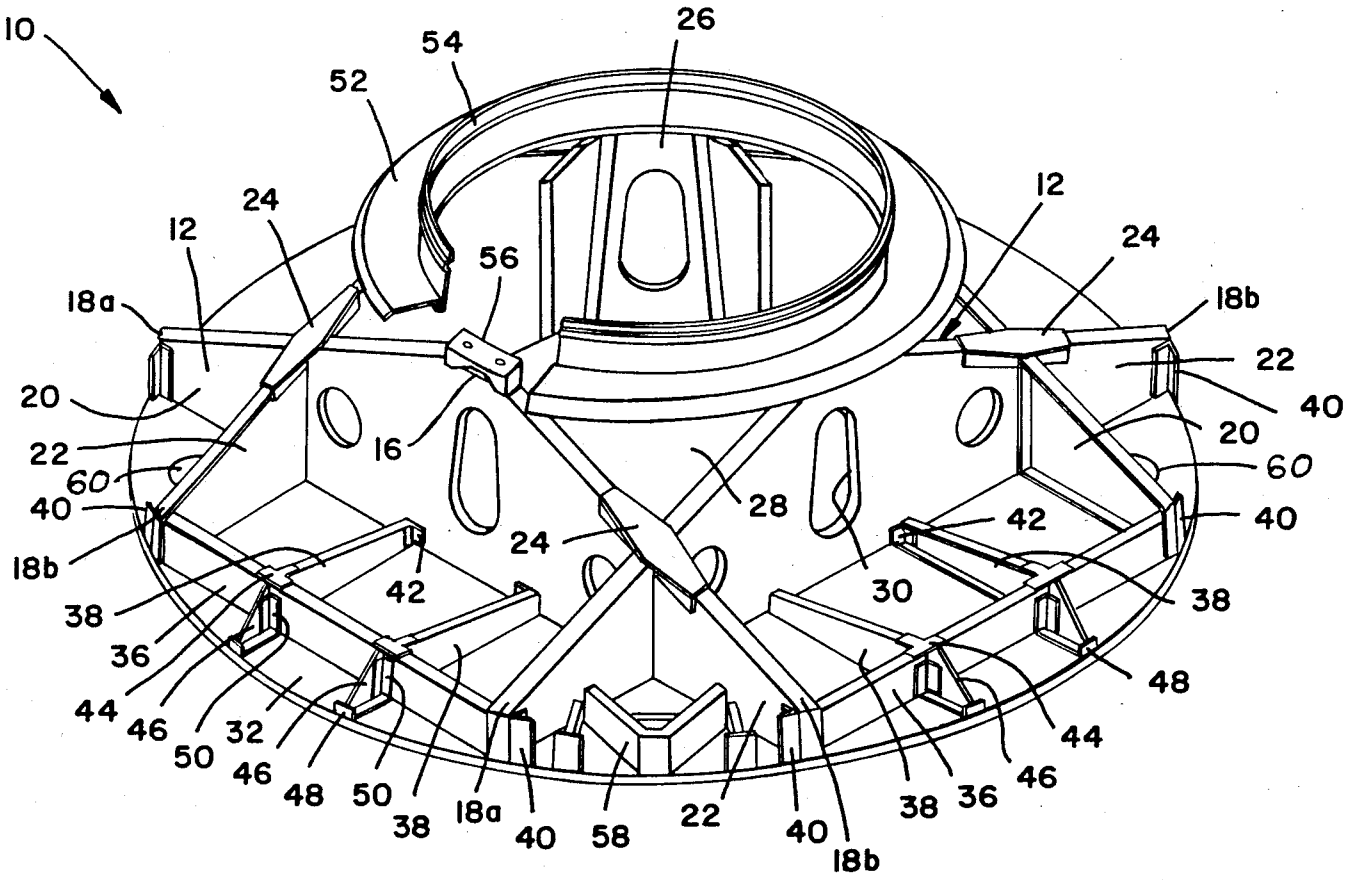
FIG. 1 is a perspective view illustrating the equipment section structure of the present invention.

FIG. 1 illustrates the mounting of various equipments on the support structure 10. An inboard support ring 52 for supporting a rocket motor mounting ring 54 is mounted on the octagonal central structure. Equipment mounting supports are illustrated by an inboard support 56 mounted at the center of a main stiffening beam 12 and a support 58 mounted on the aft panel 32 between the intersecting ends of the main beams 12 for supporting an integrated valve assembly (IVA) which is mounted in openings 60 in the aft panel.

Figure 5A:
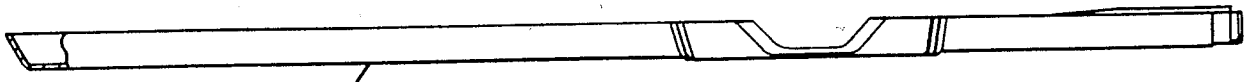
FIGS. 5*a*, 5*b* and 5*c* are an elevation view, a top plan view, and a bottom plan view, respectively, of a main section of a main stiffening beam.
Figure 5B:
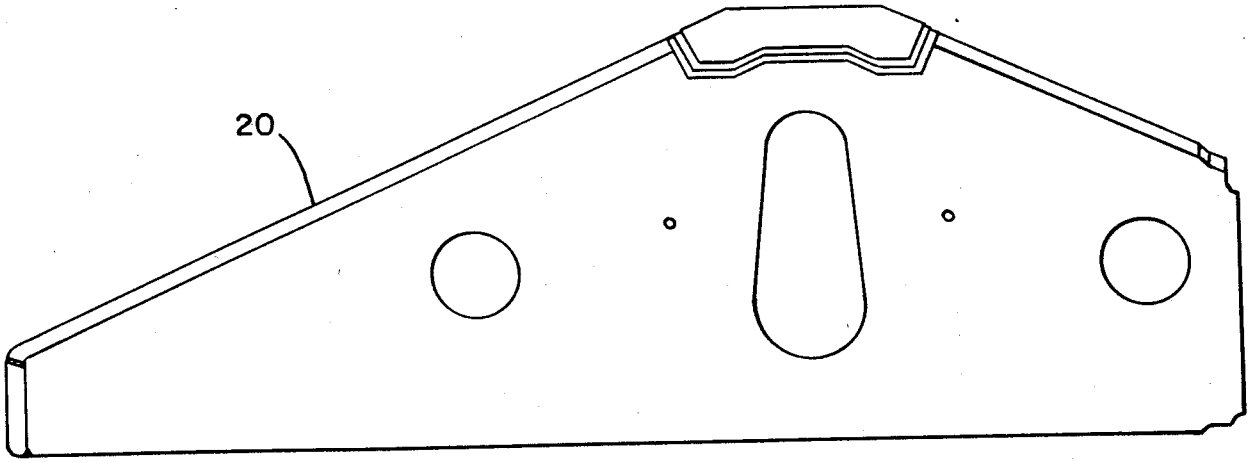
Figure 5C:
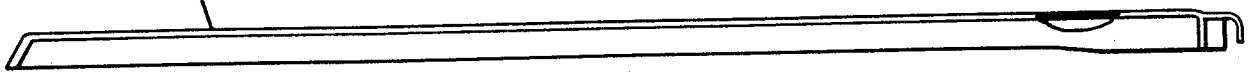
Figure 6A:
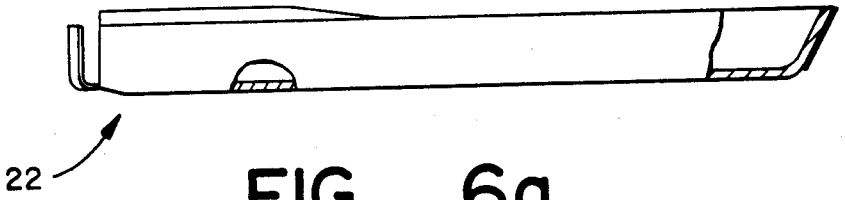
FIGS. 6*a*, 6*b* and 6*c* are an elevation view, a top plan view, and a bottom plan view, respectively, of an end section of a main stiffening beam.
Figure 6B:
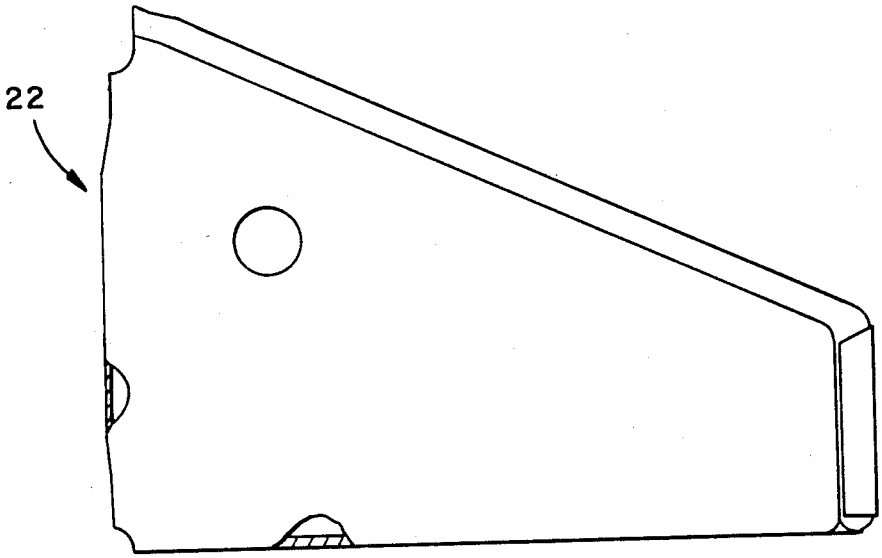
Figure 6C:
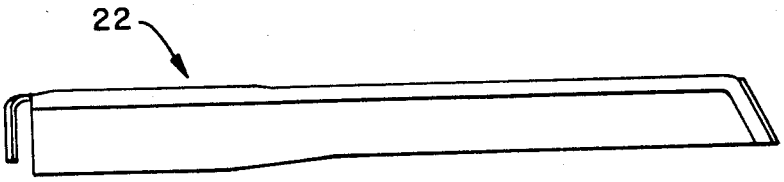
Figure 7A:
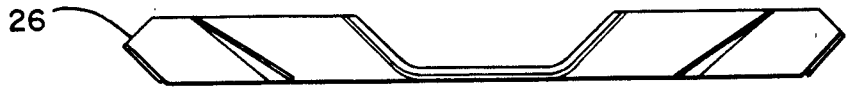
FIGS. 7*a*, 7*b* and 7*c* are an elevation view, a top plan view, and a bottom plan view, respectively, of a diagonal section.
Figure 7B:
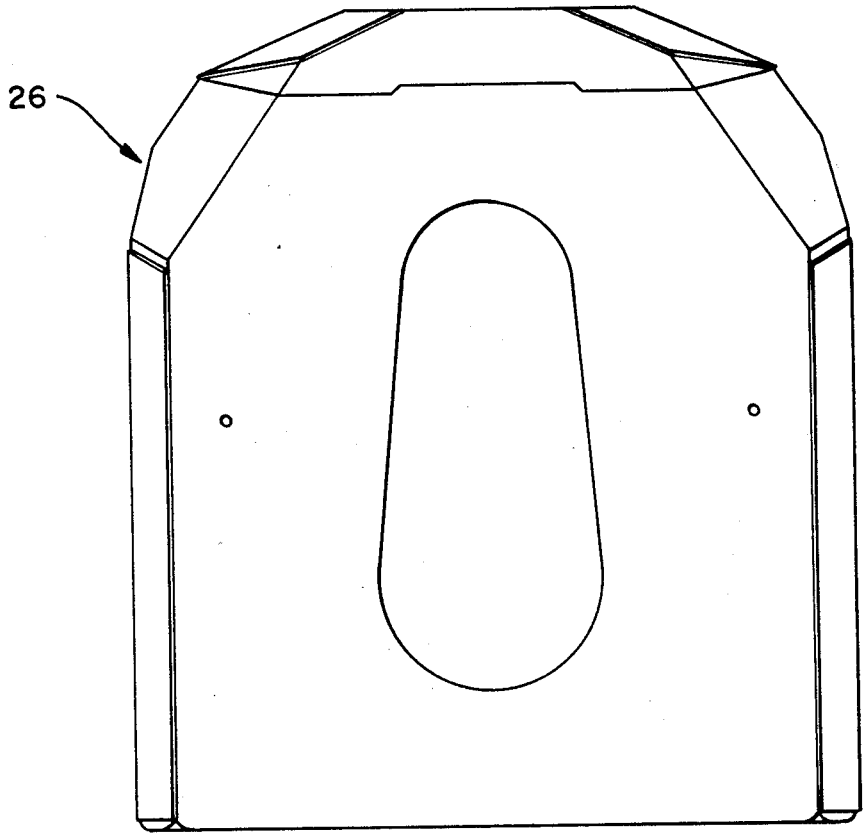
Figure 7C:
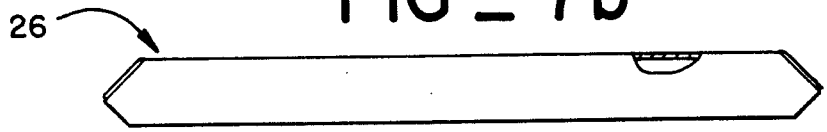
Figure 8:
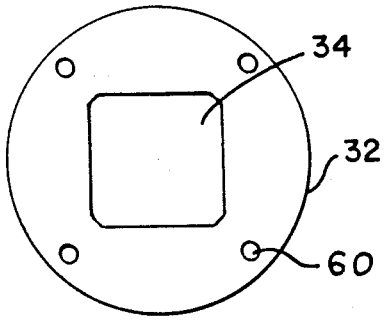
FIG. 8 is a top plan view of the aft panel.

FIGS. 5*a*, 5*b* and 5*c* are an elevation view, a top plan view, and a bottom plan view, respectively, of the main section 20 of the main beam 12. FIGS. 6*a*, 6*b* and 6*c* are an elevation view, a top plan view, and a bottom plan view, respectively, of end section 22 of the main beam 12. FIGS. 7*a*, 7*b* and 7*c* are an elevation view, a top plan view and a bottom plan view, respectively, of a diagonal beam 26. It can be seen that each beam has sides and a base to form a pan-shaped structure. Various cutouts provide accessibility to and from the interior of the octagonal center section or access through the various beams, in addition to reducing the weight of the structure.

As noted earlier, the supporting members (the main beams 12, the diagonal beams 26, the strut support beams 36, the support ribs 38, and the aft panel 32) are preferably made of graphite/epoxy laminate material to provide a strong but light weight structure. In areas where there is a strict dimensional tolerance, a sacrificial pad of fiber glass is included during the lamination process to allow machining to overcome tolerances inherent in the graphite/epoxy layup and curing process. FIG. 5 illustrates the use of sacrificial pads 56 at the apex of the main section 20 where the inboard support 52 is mounted.

Obviously, many modifications and variations of the present invention are possible in light of the above teachings. It is therefore to be understood that within the scope of the appended claims, the invention may be practiced otherwise than as described.

What is claimed and desired to be secured by Letters Patent of the United States is:

1. A missile structure for providing structural support for equipments mounted on an upper stage of a multi-stage missile, said structure being mounted within the circular outer shell of said missile, which comprises:

(a) a circular aft panel, said aft panel having a circumference adapted to abut the circular shell of said missile;

(b) four main stiffening beams, said four main stiffening beams being fixed to the forward side of said aft panel, said four main stiffening beams being disposed to intersect at right angles to form a central square structure with intersecting walls, said intersecting walls extending outward from the central square structure to the missile shell; and (c) four diagonal stiffening beams, said diagonal beams being fixed to forward side of said aft panel and to said main stiffening beams, said diagonal beams disposed within the central square structure across the corners of said central square structure, said four diagonal beams and said four main beams forming a central octagonal structure.

2. A missile structure as recited in claim 1 wherein each of said four main stiffening beams includes a main section and an end section, each said main section extending from one end of the main beam through the midpoint of the main beam to the intersection with a main section of an orthogonal main beam, said end sections extending from the intersection of the orthogonal main sections to the other end of the main beam.

3. A missile structure as recited in claim 2 wherein said main stiffening beams and said diagonal stiffening beams are pan shaped.

4. A missile structure as recited in claim 3 further including triangle support plates disposed in the corners between the diagonal stiffening beams and the intersecting main beams.

5. A missile structure as recited in claim 4 further including bracing pans mounted at the center of each said main beam and at the center of each said diagonal beam.

6. A missile structure as recited in claim 5 further comprising:

(a) four pan-shaped strut support beams mounted on said aft panel, one strut support beam extending parallel to each main beam between the ends of two orthogonal main beams; and (b) eight pan-shaped support ribs mounted on said aft panel, two support ribs extending between each main beam and a strut support beam parallel to the main beam.

7. A missile structure as recited in claim 6 wherein each said main support beam is maximum height at its midpoint and tapers to its minimum height at its ends and wherein each said diagonal beam is maximum height at its midpoint and tapers to its minimum height at its ends.

8. A missile structure as recited in claim 7 wherein said aft panel has a central opening positioned below and interior to said central octagonal structure.

9. A missile structure as recited in claim 8 made from graphite/epoxy laminate material.

* * * * *